US011215333B2

(12) United States Patent
Wang et al.

(10) Patent No.: US 11,215,333 B2
(45) Date of Patent: Jan. 4, 2022

(54) LIGHT SOURCE MODULE AND LIGHTING DEVICE

(71) Applicant: OPPLE LIGHTING CO., LTD., Shanghai (CN)

(72) Inventors: Guoping Wang, Shanghai (CN); Xuejun Feng, Shanghai (CN); Hongbo Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/908,725

(22) Filed: Jun. 22, 2020

(65) Prior Publication Data

US 2020/0318801 A1 Oct. 8, 2020

Related U.S. Application Data

(63) Continuation of application No. PCT/CN2018/124413, filed on Dec. 27, 2018.

(30) Foreign Application Priority Data

Dec. 28, 2017 (CN) ..... 201721885112.5

(51) Int. Cl.
*F21S 8/00* (2006.01)
*F21V 23/02* (2006.01)
(Continued)

(52) U.S. Cl.
CPC ..... *F21S 8/036* (2013.01); *F21V 17/002* (2013.01); *F21V 23/02* (2013.01); *F21V 23/06* (2013.01); *F21Y 2105/18* (2016.08)

(58) Field of Classification Search
CPC ..... F21V 17/002; F21V 23/02; F21V 23/06; F21V 5/046; F21V 23/005; F21V 23/003; F21Y 2105/18; F21S 8/036
(Continued)

(56) References Cited

U.S. PATENT DOCUMENTS 6,733,159 B1 5/2004 Wu
10,098,210 B2 * 10/2018 Arai ..... F21S 8/00
(Continued)

FOREIGN PATENT DOCUMENTS

CN 104456446 A 3/2015
CN 105276535 A 1/2016
(Continued)

OTHER PUBLICATIONS

International Search Report of PCT Application No. PCT/CN2018/124413 dated Mar. 27, 2019, (4p).

*Primary Examiner* — Laura K Tso
(74) *Attorney, Agent, or Firm* — Arch & Lake LLP

(57) ABSTRACT

The present disclosure provides a light source module and an illumination device which relate to the technical filed of illumination. The light source module includes a light source component and a connector piece. The connector piece is mechanically and electrically connected with the light source component, the connector piece has a mechanical connection portion and an electrical connection portion, the mechanical connection portion is mechanically connected with a base, and the electrical connection portion is electrically connected with a power supply source.

20 Claims, 9 Drawing Sheets

(51) Int. Cl.
*F21V 17/00* (2006.01)
*F21V 23/06* (2006.01)
*F21Y 105/18* (2016.01)

(58) Field of Classification Search
USPC ..... 362/368, 249.02, 216; 439/336
See application file for complete search history.

(56) References Cited

U.S. PATENT DOCUMENTS

| | | | | |
|---|---|---|---|---|
| 10,352,535 | B2 * | 7/2019 | Zhu | F21V 17/10 |
| 10,816,178 | B2 * | 10/2020 | Wang | F21V 5/00 |
| 2003/0223869 | A1 | 12/2003 | Wu | |
| 2010/0302758 | A1 * | 12/2010 | Wang | F21V 33/0076 362/20 |
| 2013/0010473 | A1 * | 1/2013 | Dellian | F21V 19/004 362/249.02 |
| 2013/0044478 | A1 * | 2/2013 | Steedly | F21K 9/23 362/235 |
| 2014/0029252 | A1 * | 1/2014 | Kato | F21V 23/002 362/235 |

FOREIGN PATENT DOCUMENTS

| | | | |
|---|---|---|---|
| CN | 106369504 | A | 2/2017 |
| CN | 207921861 | U | 9/2018 |

* cited by examiner

LIGHT SOURCE MODULE AND LIGHTING DEVICE

CROSS-REFERENCE TO RELATED APPLICATIONS

This application is based upon and claims the priority of PCT patent application No. PCT/CN2018/124413 filed on Dec. 27, 2018 which claims priority to the Chinese patent application No. 201721885112.5 filed on Dec. 28, 2017 and the Chinese patent application No. 201721890890.3 filed on Dec. 28, 2017, the entire content of all of which is hereby incorporated by reference herein for all purposes.

TECHNICAL FIELD

The present disclosure relates to a technical filed of illumination, in particular to a light source module and an illumination device with the light source module.

BACKGROUND

An illumination device may include a base and a light source module. The base may be fixedly installed on the wall, and the light source module may be detachably installed on the base. A wire from an external power supply may pass through the base and may be connected with the light source module. Thus, the mechanical connection of the light source module and the electrical connection of the light source module are achieved by different components of the light source module.

SUMMARY

The present disclosure provides a light source module, an illumination device and a method of manufacturing a light source module.

According to a first aspect of the present disclosure, a light source module is provided. The light source module may include a light source component and a connector piece, the connector piece may be mechanically and electrically connected with the light source component, the connector piece may have a mechanical connection portion and an electrical connection portion, the mechanical connection portion may be mechanically connected with a base, and the electrical connection portion may be electrically connected with a power supply source.

According to a second aspect of the present disclosure, an illumination device is provided. The illumination device may include a base and a light source module. The light source module may include a light source component and a connector piece, and the connector piece may be mechanically and electrically connected with the light source component, the connector piece may have a mechanical connection portion and an electrical connection portion, and the mechanical connection portion may be mechanically connected with a base, and the electrical connection portion may be electrically connected with a power supply source.

The base may have a connector seat, the connector seat may be electrically connected with the power supply source, and the connector seat and the connector piece may be connected with each other to realize a mechanical installation of the light source module and a connection between the light source module and the power supply source.

According to a third aspect of the present disclosure, a method of manufacturing a light source module is provided. The method may include providing a light source component and a connector piece; mechanically and electrically connecting the connector piece with the light source component, where the connector piece may have a mechanical connection portion and an electrical connection portion; mechanically connecting the mechanical connection portion with a base; and electrically connecting the electrical connection portion with a power supply source.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and form a part of the present disclosure. Examples of the present disclosure and descriptions thereof are used to explain the present disclosure and do not constitute improper limitation of the present disclosure.

DETAILED DESCRIPTION

Figure 1:
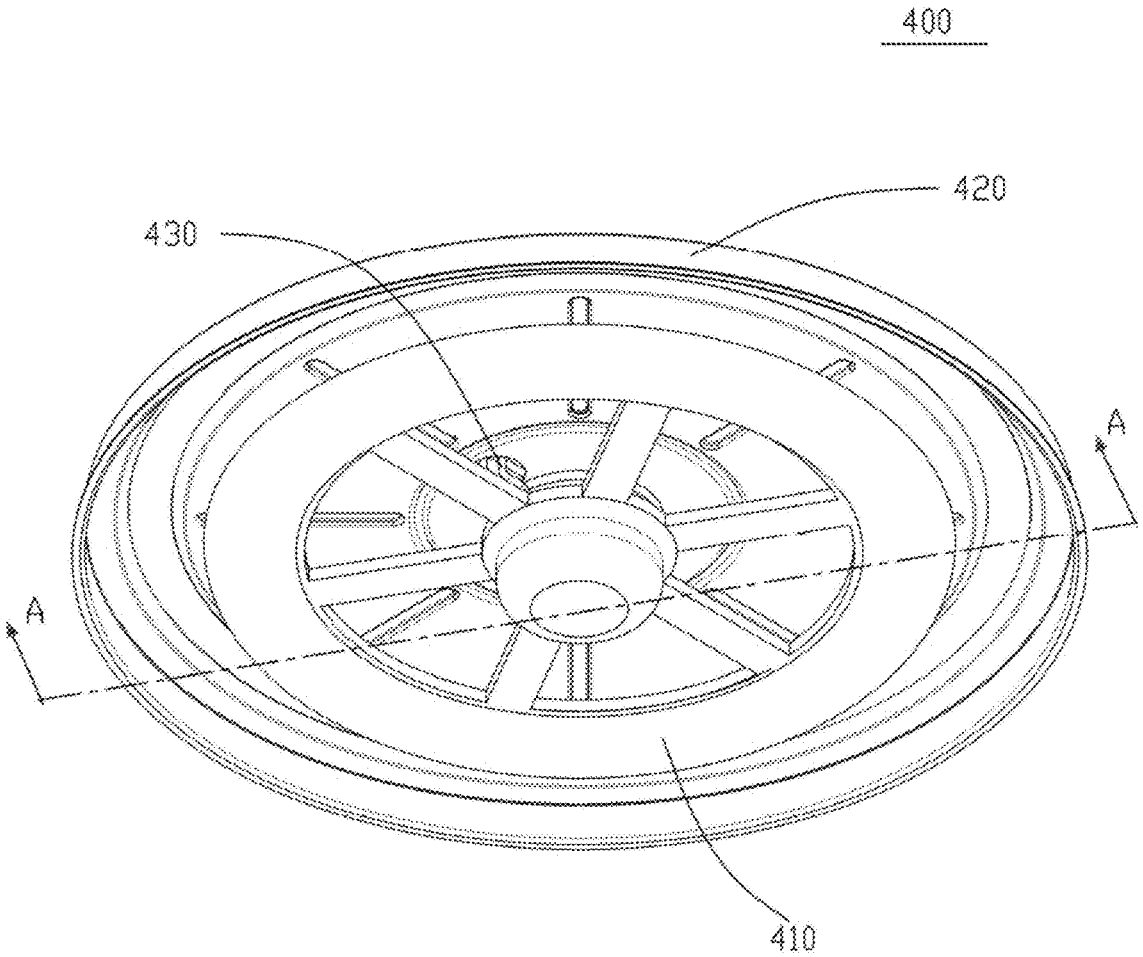
FIG. 1 is a structural view of an illumination device in an example of the present disclosure.

In order to make objects, technical solutions and advantages of the present disclosure more apparent, the technical solutions of the present disclosure will be described in a clearly and fully understandable way in connection with the examples and the drawings related to the examples of the present disclosure. Apparently, the described examples are just a part but not all of the examples of the present disclosure. Based on the examples of the present disclosure, those skilled in the art can obtain other example(s), without any inventive work, which should be within the protection scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Reference numerals referred in present disclosure are provided below:

100—Connector seat; 110—Base body;

111—Electrical cavity; 1111—Sliding platform 1112—Drive hole; 1113—Arc-shaped hole; 1114—Opening of electrical cavity; 1115—First slot; 1116—Second slot; 1117—Third slot; 1118—Fourth slot;

113—Wire passing hole;

114—Installation ring;

115—Insulation cover; 1151—Pressure plate; 1152—Connecting arm;

116—Mechanical cavity; 1161—Guide notch; 1162—Stuck notch; 1163—Opening of mechanical cavity;

120—Wire connection portion; 121—First elastic member; 1211—First installation portion;

122—Control key; 1221—Push portion; 1222—Drive portion; 123—First conductive sheet;

130—Terminal connection portion; 131—Second elastic member; 132—Second conductive sheet;

140—Conductive sheet installation portion;

200—Connector piece; 210—Main body; 211—Buckle; 220—Conductive terminal; 221—First portion; 222—Second portion;

300—Connector component;

400—Illumination device;

410—Light source module; 411—Light source component; 411*a*—Light source substrate; 411*b*—Light emitting unit; 411*c*—Installation hole; 412—Power supply component; 413—Light distribution element; 413*a*—Accommodation portion; 413*b*—Optical portion; 413*c*—Connection portion; 413*d*—Button;

420—Base; 421—Reinforcing rib; 430—Wire.

When the mechanical connection of the light source module and the electrical connection of the light source module are realized by different components of the light source module, and the mechanical connection of the light source module and the electrical connection of the light source module are disposed in different directions, the installation of the light source module and the disassembly of the light source module in the illumination device are not convenient and fast.

Figure 2:
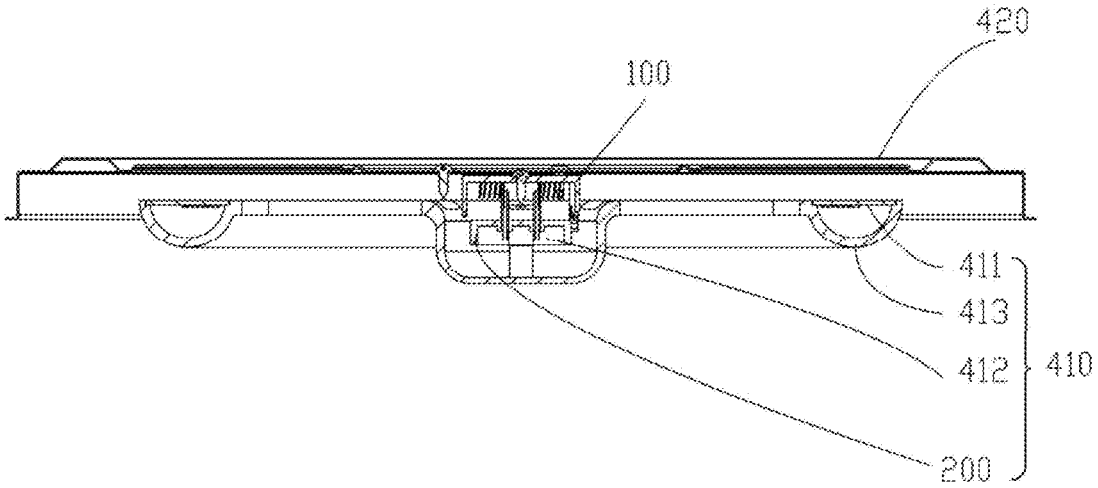
FIG. 2 is a cross-sectional view taken along a line A-A of the illumination device in FIG. 1.
Figure 3:
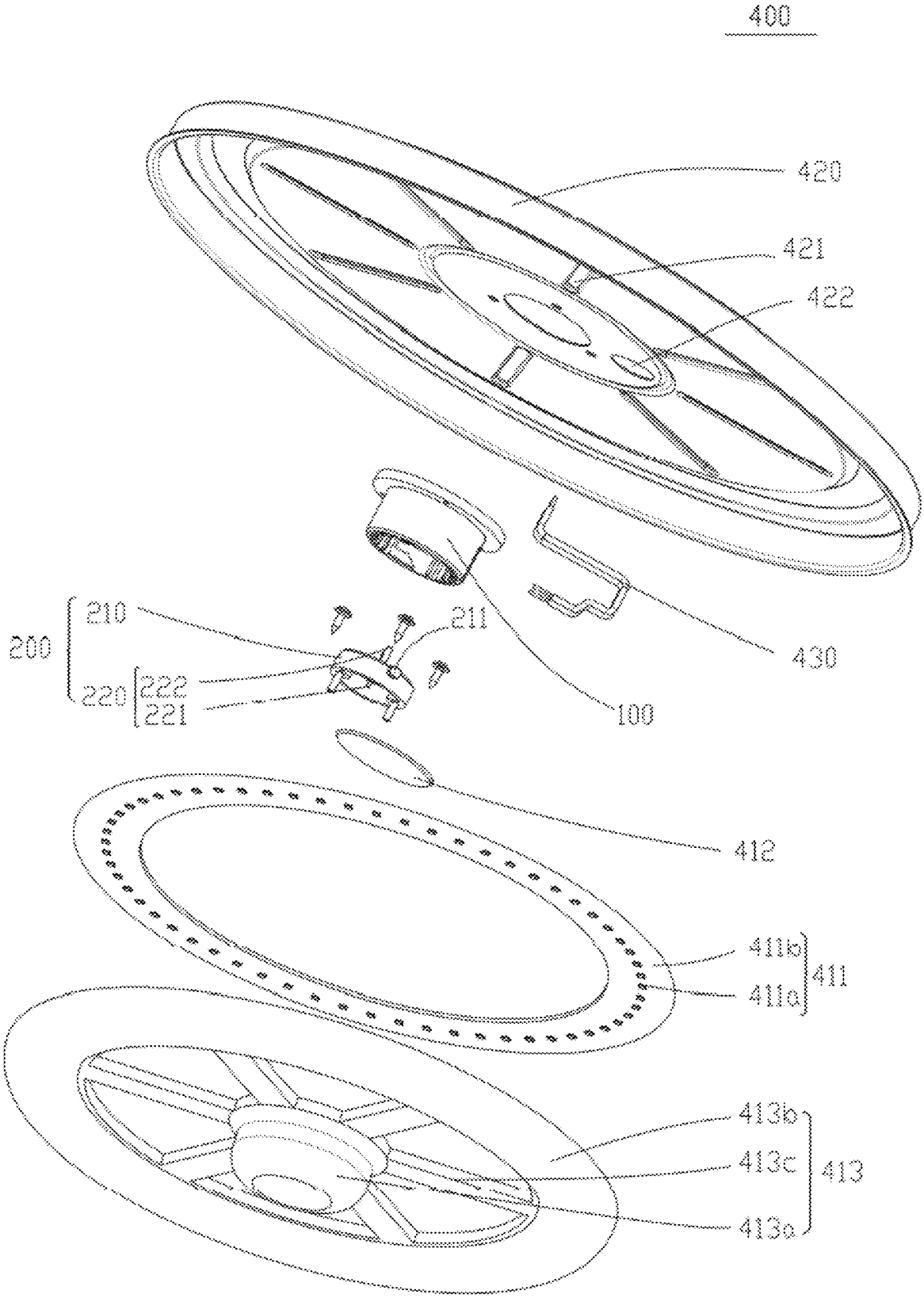
FIG. 3 is an exploded view of the illumination device in FIG. 1 at a viewing angle.

In an example of the present disclosure, an illumination device 400 is provided. As shown in FIG. 1, FIG. 2, and FIG. 3, the illumination device 400 includes a light source module 410 and a base 420, and further includes a wire 430. The light source module 410 includes a light source component 411 and a connector piece 200. The connector piece 200 is mechanically and electrically connected with the light source component 411, the connector piece 200 has a mechanical connection portion and an electrical connection portion, the mechanical connection portion is mechanically connected with the base 420, and the electrical connection part is electrically connected with a power supply source. The base 420 and the power supply source are connected with the connector piece 200 at the same time, so that the operation of respectively connecting the base 420 and the power supply source with two different components, during installing and disassembling the light source module 410, is avoided, thereby improving the efficiencies of the installation of the light source module 410 and the disassembly of the light source module 410. A connector seat 100 is fixedly installed on the base 420, and the connector seat is electrically connected with the power supply source, that is, the wire 430 connecting the power supply source and passing through the base 420 is electrically connected with the connector seat 100, and the connector seat 100 is mechanically and electrically connected with the connector piece 200 in a detachable manner, so that the rapid installation of the light source module 410 and the rapid disassembly of the light source module 410 are realized.

The electrical connection portion of the connector piece 200 penetrates through the mechanical connection portion of the connector piece 200, and the electrical connection portion electrically connects the light source component 411 and the power supply source respectively at two sides of the mechanical connection portion. As a modification example, the electrical connection portion is arranged at a same side of the mechanical connection portion, and the light source component 411, the power supply source, and the base 420 are arranged at the same side of the mechanical connection portion.

Because the electrical connection portion penetrates through the mechanical connection portion, the electrical connection portion is electrically connected with the light source component 411 at one side of the mechanical connection portion, and the electrical connection portion is electrically connected with the power supply source at the other side of the mechanical connection portion; correspondingly, the base 420 is arranged at a side provided with the power supply source, and is opposite to the light source component 411, thus, the connector seat 100 and the connector piece 200 are arranged between the light source component 411 and the base 420. As a modification example, the electrical connection portion is arranged at the same side of the mechanical connecting part, the light source component 411, the power supply source, and the base 420 are arranged at the same side of the mechanical connection portion.

In the light source module 410, an extension direction of the connector piece 200 and an insertion direction of the connector piece 200 are perpendicular to a surrounding plane surrounded by the light source component 411. The light source component 411 includes a light source substrate 411*a* and a plurality of light emitting units 411*b*. The plurality of light emitting units 411*b* are installed at a surface of the light source substrate 411*a*, and the connector piece 200 faces away from the plurality of light emitting units 411*b*. The extension direction of the light source substrate 411*a* is perpendicular to the insertion direction of the connector piece 200, and the plurality of light emitting units 411*b* is installed at the surface of the light source substrate 411*a*, and the connector piece 200 faces away from the plurality of light emitting units 411*b*, so that after the light source module 410 is installed on the base 420 by the connector piece 200, the plurality of light emitting units 411*b* face away from the base 420. As a modification example, the extension direction of the light source substrate 411*a* is parallel to the insertion direction of the connector piece 200, that is, the light source substrate 411*a* surrounds the connector piece 200 and has a cylindrical shape, and the plurality of light emitting units 411*b* are arranged on a surface of the light source substrate 411*a* or are arranged two opposite surfaces of the light source substrate 411*a*, such as an inner surface of the cylindrically-shaped light source substrate 411*a* or both of the inner surface and an outer surface of the cylindrically-shaped light source substrate 411*a*.

The light source substrate 411*a* surrounds an accommodation region, and the connector piece 200 is arranged in the accommodation region. The light source module 410 further includes a power supply component 412, and the power supply component 412 is further arranged in the accommodation region. The power supply component 412 is electrically connected with the connector piece 200 and the light source component 411, and the power supply component 412 is electrically connected between the connector piece 200 and the light source component 411, that is, the power is transmitted to the power supply component 412 by the connector piece 200, and the power supply component 412 then transmits the power to the light source component 411.

The power supply component 412 includes a power supply substrate and a plurality of elements arranged at at least one surface of the power supply substrate. The power supply substrate and the light source substrate 411*a* for example are arranged integrally. The power supply substrate and the light source substrate 411*a* for example are arranged separately, then the power supply substrate and the light source substrate 411*a* are electrically connected with each other by a wire or an electrical connector.

The power supply component 412 further is integrated with a control module, and the control module receives bluetooth and/or WiFi signals for communication and signal transmission, or performs functions of light adjustment and/or color adjustment, or other functions.

As a modification example, the power supply component 412 is not arranged in the above-mentioned accommodation region. The power supply component 412 is installed on a wall or on the base and is electrically connected between the power supply source and the connector seat 100 provided on the base 420 to supply the power to the light source component 411. If the power supply component 412 is installed on the base, the power supply component 412 for example is provided to deviate a region of the light source component 411.

The mechanical connection portion of the connector piece 200 includes a main body 210, and the electrical connection portion of the connector piece 200 includes a conductive terminal 220. Herein, the conductive terminal 220 penetrates through the main body 210, and the conductive terminal 220 includes a first portion 221 and a second portion 222, and the first portion 221 and the second portion 222 are respectively arranged at two sides of the main body 210. Herein, the first portion 221 is configured to be electrically connected with the light source component 412; and the second portion 222 is configured to be electrically connected with the power supply source, the second portion 222 is connected with the connector seat 100 provided on the base 420, and extends into a terminal connection portion 130 in the connector seat 100 to realize an electrical connection of the connector piece 200 and the connector seat 100. The conductive terminal 220 further includes a third portion connecting the first portion 221 and the second portion 222, and the third portion is clamped inside the main body 210, so that the conductive terminal 220 is fixedly installed on the main body. The power supply component 412 has an insertion port. During the connector piece 200 is inserted toward the power supply component 412, the first portion 221 is inserted into and connected with the insertion port of the power supply component 412, so that the electrical connection between the connector piece 200 and the power supply component 412 is realized.

The main body 210 of the connector piece 200 has a side wall surrounding the conductive terminal 220. The side wall has an outer surface parallel to an extension direction of the conductive terminal. At least two catching portions are arranged on the outer surface, and the at least two catching portions are stuck with the connector seat 100 provided on the base 420. Each of the at least two catching portions is a buckle 211 which is configured to be stuck with a stuck notch of the connector seat 100. As a modification example, each of the at least two catching portions of the connector piece 200 is a stuck notch, and correspondingly, the connector seat 100 has a buckle, so that the connection between the connector piece 200 and the connector seat 100 is also realized in the stuck manner.

In one example of the present disclosure, the main body 210 of the connector piece 200 has a cylindrical shape, and at least two buckles 211 are arranged on a circumferential side wall of the main body 210. Two buckles 211 are symmetrically arranged to respectively be stuck with two stuck notches 1162 provided on the connector seat 100. As a modification example, three buckles 211 are uniformly arranged on the main body 210 of the connector piece, and correspondingly, three stuck notches 1162 are uniformly arranged on the connector seat. The total number of the buckles 211 may be more than three and the total number of the stuck notches 1162 may be more than three.

The light source module 410 described above further includes a light distribution element 413. The light distribution element 413 includes an accommodation portion 413*a* and an optical portion 413*b*, the accommodation portion 413*a* is configured to accommodate the power supply component 412 and a portion of the connector piece 200, and the optical portion 413*b* is configured to accommodate the light source component 411 and cover the plurality of light emitting units 411*b* of the light source component 411 to distribute light from the plurality of light emitting units 411*b*. The light source component 411, the power supply component 412, and the connector piece 200 are quickly assembled and connected by the light distribution element 413.

Figure 4:
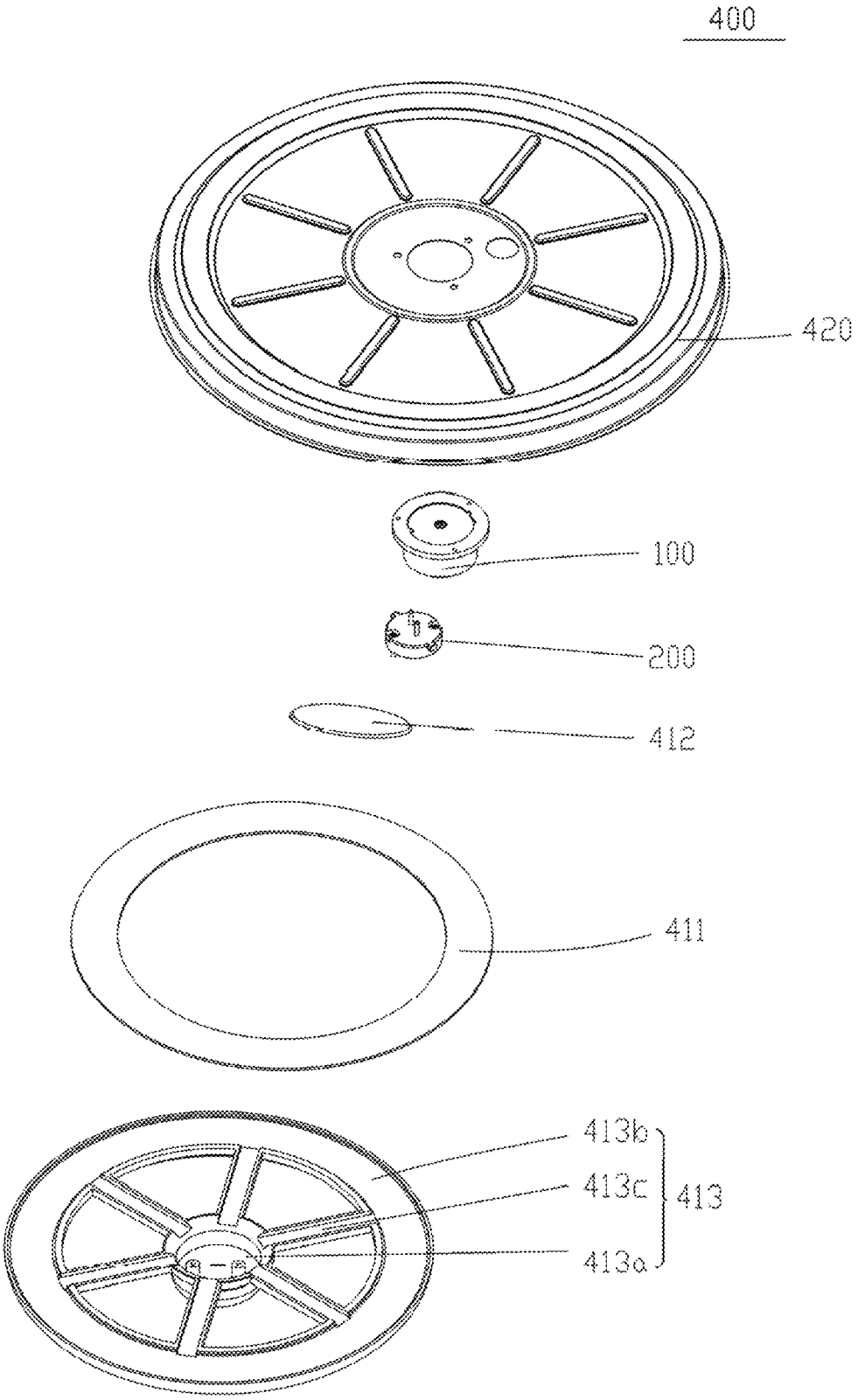
FIG. 4 is an exploded view of the illumination device in FIG. 1 at another viewing angle.

As shown in FIG. 3 and FIG. 4, the light source component 411 surrounds the connector piece 200, the optical portion 413*b* surrounds the accommodation portion 413*a*, and the accommodation portion 413*a* is located in an accommodation region surrounded by the optical portion 413*b*. The accommodation portion 413*a* may be the middle portion of the accommodation region surrounded by the optical portion 413*b*.

As a modification example, the optical portion 413*b* and the accommodation portion 413*a* are respectively disposed at two ends of the light distribution element 413. In this case, the light source component 411 and the power source component 412 are correspondingly arranged at two ends of the light source module, and the connector piece 200 is arranged on the power supply component 412.

The light distribution element 413 further includes a connection portion 413*c* connecting the accommodation portion 413*a* and the optical portion 413*b*, and at least two connection portions 413*c* divide the accommodation region into at least two separated spaces. The connection portions 413*c* divide the accommodation region into several separated spaces, which is related to the structures of the accommodation portion 413*a* and the optical portion 413*b*. If the accommodation portion 413*a* (in other words, the power supply component and the connector seat) is arranged in the middle region, and the optical portion 413*b* (in other words, the light source component) surrounds the accommodation portion 413*a* and is not directly in contact with the accommodation portion 413*a*, at least two connection portions 413*c* divide the accommodation region into at least two separated spaces. For example, two connection portions 413*c* divide the accommodation region into two separated spaces, and three connection portions 413*c* divide the accommodation region into three separated spaces. If the accommodation portion 413*a* is provided at a position deviating the middle region of the accommodation region surrounded by the optical portion 413*b* and an end of the accommodation portion 413*a* is in direct contact with the optical portion 413*b*, the accommodation region is divided into at least three separated spaces by at least two connection portions 413*c*. For example, two connection portions 413*c* divide the accommodation region into three separated spaces, and three connection portions 413*c* divide the accommodation region into four separated spaces.

Referring to FIG. 3 and FIG. 4, an accommodation groove is arranged at a side of the accommodation portion 413*a* facing the connector seat 100, and the power supply component 412 and a portion of the connector piece 200 are sequentially accommodated in the accommodation groove. The accommodation groove has an opening and the main body of the connector piece covers the opening. An internally threaded column is arranged on a bottom wall of the accommodation groove, a threaded hole is correspondingly arranged in the power supply component, and an internally threaded column penetrating through the main body of the connector piece is correspondingly arranged on a surface (that is, the surface having the first portion 221), facing the accommodation portion 413*a*, of the main body of the connector piece. The power supply component 412 is arranged in the accommodation groove and installed on the internally threaded column. While the internally threaded column of the connector piece 200 is aligned and connected with the internally threaded column of the accommodation groove, the first portion 221 of the connector piece 200 is inserted into and connected with the insertion port of the power supply component 412 in the accommodation groove. A fastener passes through the threaded columns and the threaded hole to install and fix the connector piece 200 in the accommodation groove, and simultaneously to complete the electrical connection of the connector piece 200 and the power supply component 412.

A side of the optical portion 413*b* facing the light source component 411 has a recess that accommodates the light source component 411 (FIG. 3 and FIG. 4) or the light emitting unit 411*a* (FIG. 5) of the light source component 411. A wire slot is arranged at a side of the connection portion 413*c* facing the connector piece, and the wire slot is configured to arrange the wire.

The light distribution element 413 has two opposite surfaces, i.e. a first surface and a second surface. Herein, the first surface faces the light source component 411, the connector piece 200, and the power supply component 412, and the second surface is a light emitting surface. The accommodation groove, the recess, and the wire slot, which are described above, are all arranged on the first surface.

In the case that the accommodation portion 413*a* of the light distribution element 413 is not in direct contact with the optical portion 413*b* of the light distribution element 413, the power supply substrate and the light source substrate 411*a* are separately arranged, and the power supply substrate and the light source substrate 411*a* are connected with each other by a wire, and the wire is arranged in the wire slot of the connection portion 413*c*. In the case that the accommodation portion 413*a* of the light distribution element 413 is in direct contact with the optical portion 413*b* of the light distribution element 413, the power supply substrate and the light source substrate 411*a* may be arranged integrally or separately. If the power supply substrate and the light source substrate 411*a* are arranged separately, the power supply substrate and the light source substrate 411*a* are electrically connected with each other by a wire or an electrical connector, and the electrical connector is arranged at the junction of the accommodation portion 413*a* and the optical portion 413*b*.

The light source module 410 further include a cover plate (not shown), which cooperates with the optical portion 413*b* to seal the recess, thereby sealing the light source component inside the optical portion 413*b*. The cover plate may further seal the wire slot of the connection portion 413*c* to protect the wire provided in the wire slot.

Figure 5:
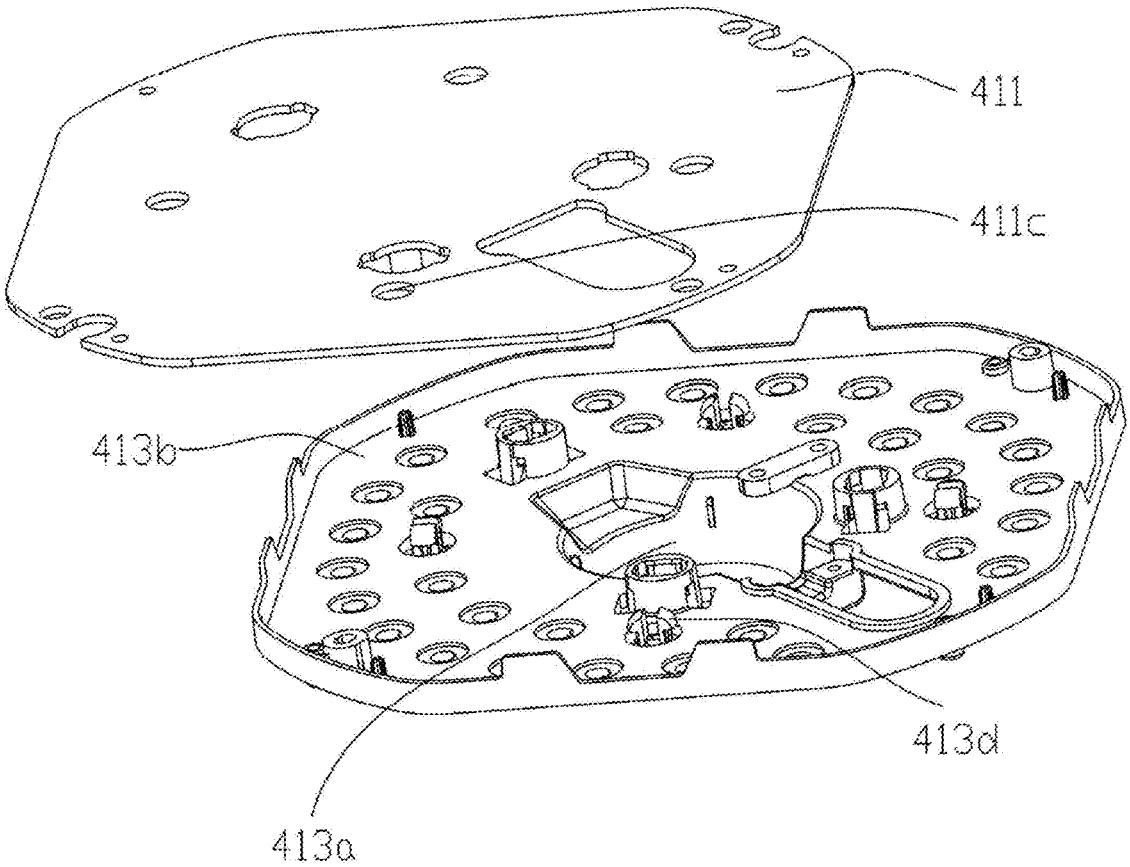
FIG. 5 is a structural view of a light source component and a light distribution element in the example of the present disclosure of FIG. 1.

The light source component 411 may be installed and fixed on the light distribution element 413 by the cover plate, or be connected with the light distribution element 413 in a screwed manner, or may be installed on and connected with the light distribution element 413 in a buckling manner. As shown in FIG. 5, the optical portion 413*b* of the light distribution element 413 has recesses that respectively match with the plurality of the light emitting units 411*b* to complete the distribution of light from each of the plurality of light emitting units 411*b*, and the optical portion 413*b* of the light distribution element 413 further has several transition regions that are arranged between the recesses and are bonded to the light source substrate 411*a*. The transition regions are provided with buttons 413*d*, each of the buttons has a hook, installation holes 411*c* are respectively formed at positions corresponding to the buttons on the light source substrate 411*a*, and each of the buttons 413*d* penetrate into the corresponding installation hole 411*c* so that the hook hooks the light source substrate 411*a* to realize the connection of the light source component 411 and the light distribution element 413. In FIG. 5, the light source substrate 411*a* and the power supply substrate may be integrally formed, the plurality of light emitting units 411*b* and the components of the power supply component 412 are all arranged on the integrated substrate, and the connector piece 200 (not shown in FIG. 5) may be partially accommodated in the accommodation portion 413*a*.

The light source substrate 411*a* of the light source component may have a circular ring shape, a square ring shape, or any other approximate ring shape. The light source substrate 411*a* may have a closed circular ring shape, a closed square ring shape, or any other approximate closed ring shape, or may have a circular shape having an opening, a square ring shape having an opening, or other approximate ring shape having an opening. Correspondingly, the shape of the optical portion 413*b* of the light distribution element may be changed accordingly. The orthographic projection of the accommodation portion 413*a* of the light distribution element on the base may be a circular shape, a square shape, a rectangular shape, or any other irregular shape. In the case that the light source substrate 411*a* and the power supply substrate are integrally formed, the integrated substrate of the two substrates may have a circular shape, a triangular shape, a rectangular shape, a polygonal shape, or other irregular shape.

The light source module 410 in the illumination device 100 and the connector piece installed on the light source module 410 have been described above. The base 420 in the illumination device and the connector seat 100 installed on the base 420 will be described in detail below.

As shown in FIG. 3, the base 420 is usually fixedly installed on a ceiling, a wall or a fixed object in air, and is used to install the light source module 410. The base 420 has a circular plate shape or a square plate shape. The base 420 has reinforcing ribs 421 that radiate outwardly from the center of the base 420. The connector seat 100 is connected with the center of the base 420 through screws. The center of the base 420 has a through hole, and the through hole accommodates an insulation cover 115 of the connector seat 100, that is, the connector seat 100 is connected with the center of the base 420. Connecting holes are provided on the periphery of the through hole, and fasteners pass through holes of an installation ring 114 of the connector seat 100 and the connecting holes to install the connector seat 100 onto the base. In addition, a wire hole is provided at a side of the through hole, the wire hole is suitable for a wire 430 to pass through, so that the wire 430 drawn from the wall or an installation position passes from the back surface of the base 420 to the front surface of the base 420 and is connected with the connector seat 100.

The connector seat 100 is configured to connect the connector piece 200 and the wire that correspond to the connector seat 100, so that the wire 430 and the connector piece 200 are electrically connected with each other.

Figure 6:
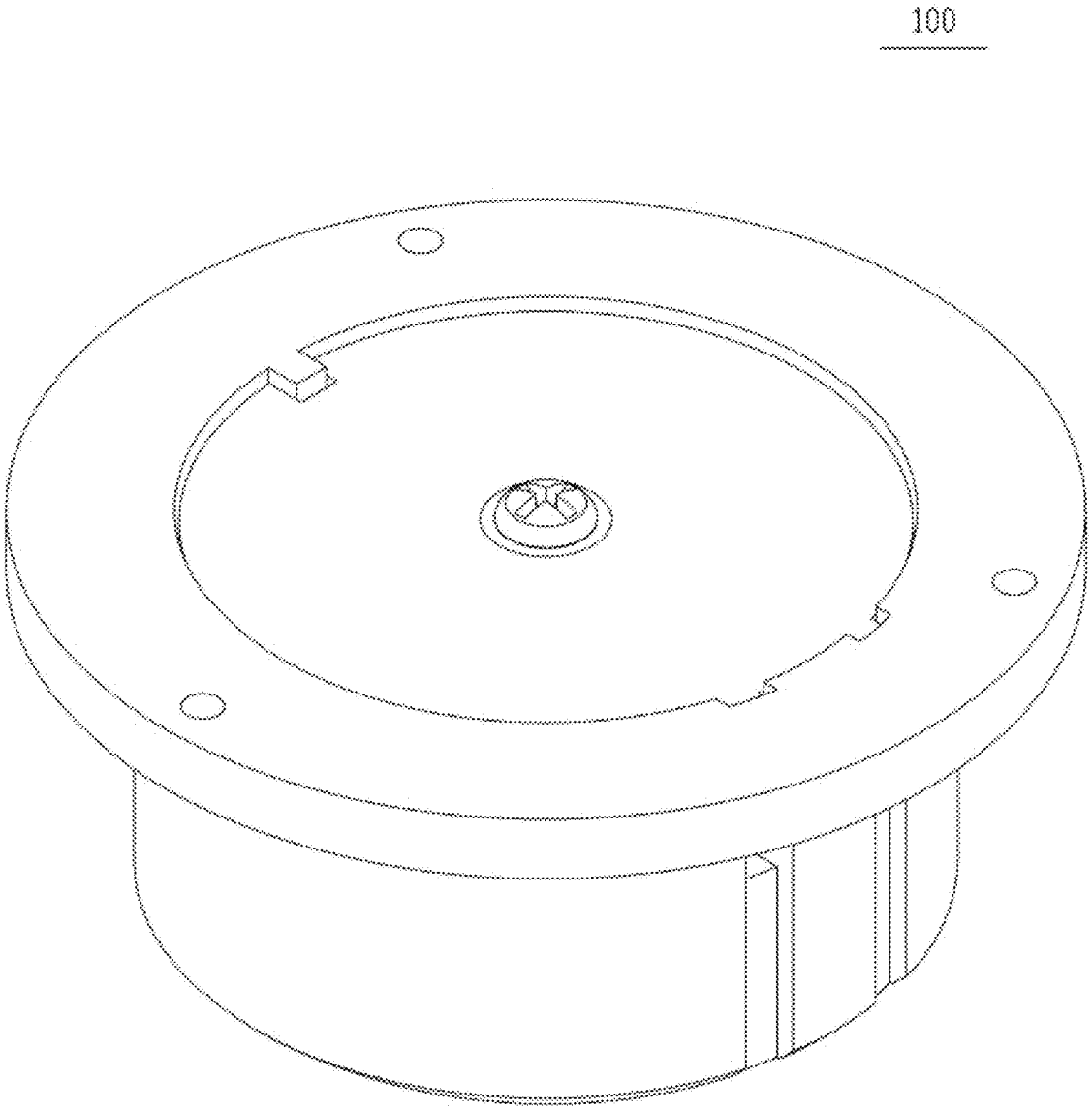
FIG. 6 is a structural view of a connector seat of the illumination device in FIG. 1.
Figure 7:
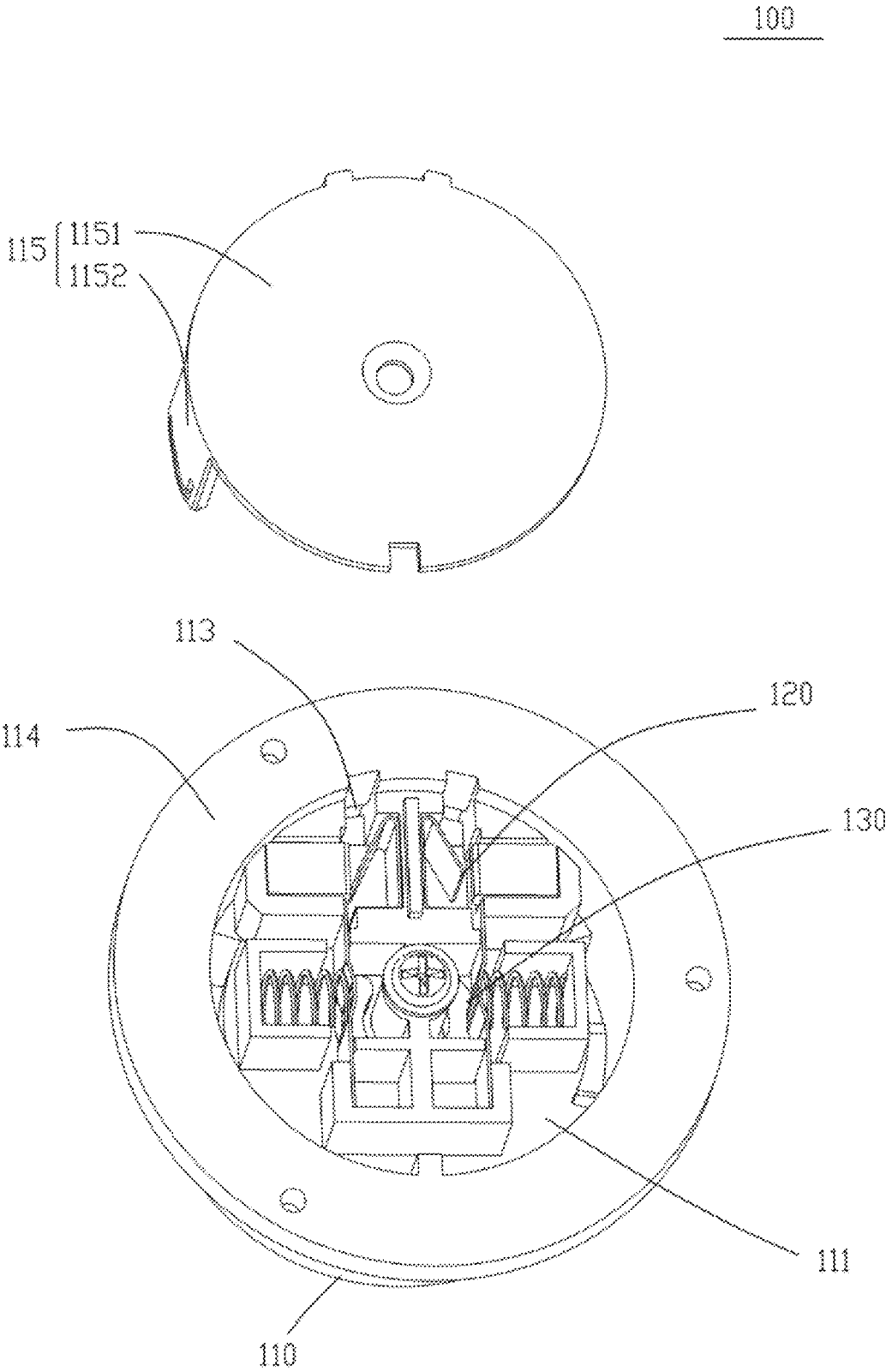
FIG. 7 is an internal structural view of an electrical cavity of the connector seat in FIG. 6.
Figure 8:
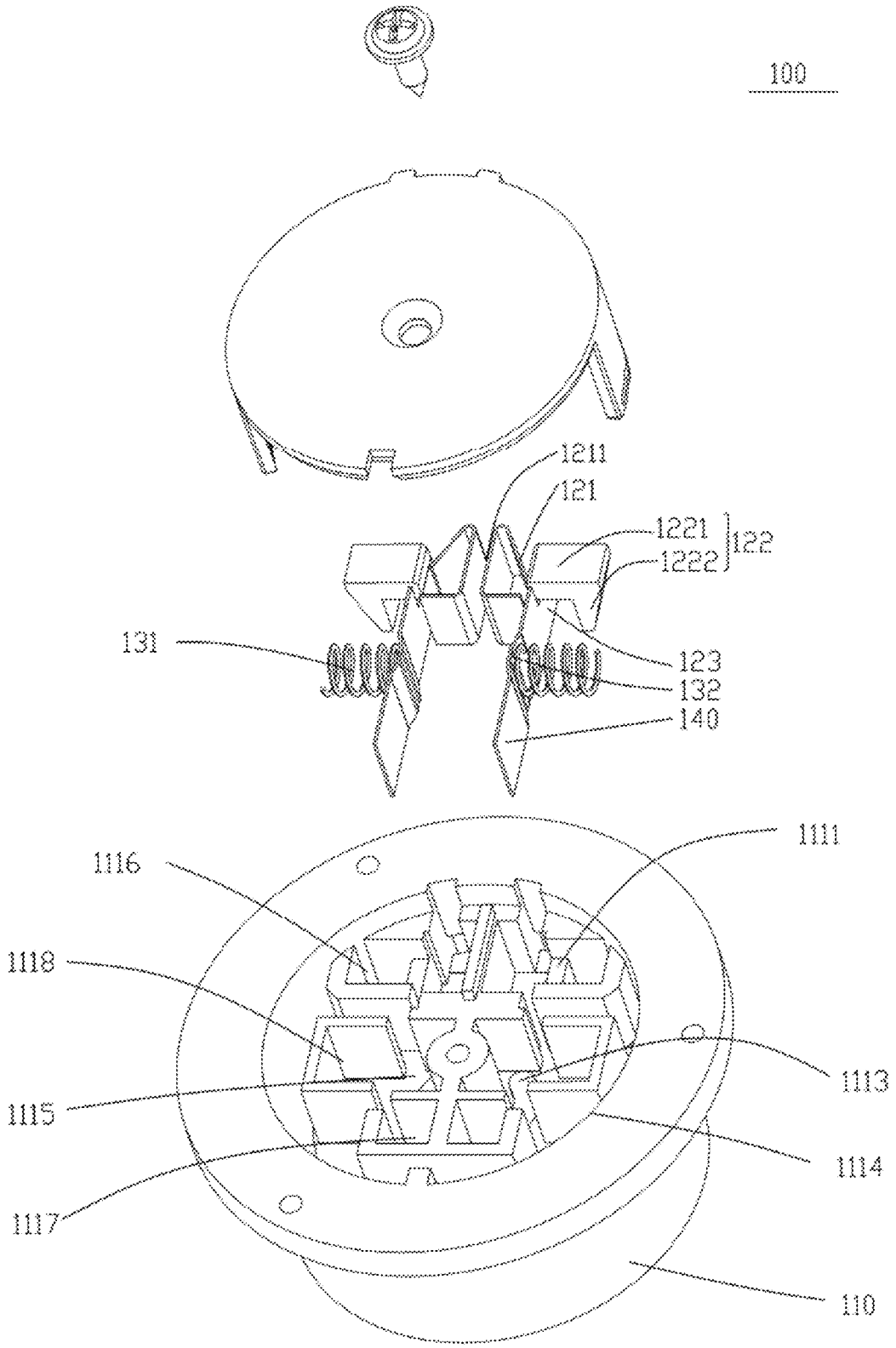
FIG. 8 is an exploded view of the connector seat in FIG. 6.

Referring to FIG. 6, FIG. 7, and FIG. 8, the connector seat 100 includes a base body 110 and a wire connection portion 120. The base body 110 has an electrical cavity 111, and the wire connecting portion 120 is arranged in the electrical cavity 111. The wire connecting part 120 is configured to connect the wire 430 and transmit the power input by the wire 430 to a conductive sheet 123 of the connector seat 100.

The wire connection portion 120 includes a first conductive sheet 123, a first elastic member 121, and a control key 122. The first elastic member 121 applies elastic force toward the first conductive sheet 123 to press the wire tightly onto the first conductive sheet 123. The control key 122 drives the first elastic member 121 to move away from the first conductive sheet 123 to reduce the pressing force of the first elastic member 121 on the wire, thereby facilitating the separation of the wire 430 from the connector seat 100. During the wire 430 is connected with the connector seat 100, the elastic force that is generated upon the wire resisting against the first elastic member 121 is directly introduced between the first conductive sheet 123 and the first elastic member 121, and the wire is pressed tightly onto the first conductive sheet 123 by the first elastic member 121 to realize quick electrical connection of the connector seat 100 and the wire. In the case that the wire needs to be detached from the connector seat, the first elastic member 121 is driven to move away from the first conductive sheet 123 by the control key 122, so that the pressing force exerted on the wire is reduced, and the connector seat 100 is quickly separated from the wire.

The first elastic member 121 is provided such that the plane where the first elastic member 121 is located intersects the middle portion of the first conductive sheet 123, which ensures that the wire can still be pressed tightly onto the first conductive sheet 123 even when the first elastic member 121 is displaced. The first elastic member 121 may abut against and connect with the middle portion of the first conductive sheet 123, or may maintain a gap with the middle portion of the first conductive sheet 123. The gap should be smaller than the diameter of the wire so that the wire can be pressed tightly onto the first conductive sheet 123.

As a modification example, the plane where the first elastic member 121 is located may intersect two ends of the first conductive sheet 123 other than the middle portion.

The first elastic member 121 includes a pressing edge adjacent to the first conductive sheet 123 for abutting against and connecting with the wire, the pressing edge is parallel to the first conductive sheet 123, and the distance between the pressing edge and the first conductive sheet 123 is smaller than the diameter of the wire.

The first elastic member 121 is inclined with respect to the first conductive sheet 123, and the wire passes between the first elastic member 121 and the first conductive sheet 123 at an acute angle between the first elastic member 121 and the first conductive sheet 123. In other words, the first elastic member 121 is set as a first half plane, and the first conductive sheet 123 has a second half plane and a third half plane separated by the first half plane. Herein, the angle between the first half plane and the second half plane is A, the angle between the first half plane and the third half plane is B, and the sum of A and B is 180 degrees. If A is an acute angle, the wire passes between the first elastic member 121 and the first conductive sheet 123 at A. If B is an acute angle, the wire passes between the first elastic member 121 and the first conductive sheet 123 at B. The wire passes between the first elastic member 121 and the first conductive sheet 123 at the acute angle, so that the wire can conveniently pass with resisting a small elastic force.

In practical application, the first elastic member 121 with a sheet shape may be perpendicular to the first conductive sheet 123.

It should be noted that the connector seat 100 further includes a first installation portion 1211 integrally formed with the first elastic member 121. The first installation portion 1211 is fixedly installed in the electrical cavity 111, and the first installation portion 1211 has a bendable flat plate shape. The first elastic member 121 is close to the first conductive sheet 123, while the first installation portion 1211 is away from the first conductive sheet 123. The first installation portion 1211 and the first elastic member 121 form a V-shape, and the included angle between the first installation portion 1211 and the first elastic member 121 is an acute angle, so that the first elastic member 121 has a large elastic force and can be reset when the external force disappears.

The base body 110 of the connector seat 100 has an annular shape, and the side wall of the base body 110 surrounds the electrical cavity 111. The side wall of the base body has a wire passing hole 113 through which the wire passes from an outer side of the connector seat into the electrical cavity 111. The opening of the acute angle formed by the first elastic member 121 and the first conductive sheet 123 faces the wire passing hole 113, and the axial direction of the wire passing hole 113 is parallel to the first conductive sheet 123.

In the examples of the present disclosure, the electrical cavity 111 has two wire connection portions 120 which are symmetrically arranged, and the base body 110 has two wire passing holes 113, so that two wires 430 respectively penetrate into the electrical cavity 111 through the wire passing holes 113 and are respectively connected with the corresponding wire connection portions 120.

The electrical cavity 111 has an opening 1114 and a bottom wall, herein the bottom wall is arranged opposite to the opening 1114. The first elastic member 121 and the first conductive sheet 123 are arranged on the bottom wall. A control key installation portion configured to install the control key 122 is arranged on the bottom wall. The control key 122 is installed on the control key installation portion in a reciprocally slidable manner, and the control key 122 drives the first elastic member 121 to approach to or depart from the first conductive sheet 123 by reciprocally sliding at the bottom wall.

In the examples of the present disclosure, the control key 122 is arranged in parallel with the first conductive sheet 123 and opposite to the first elastic member 121. If the control key 122 slides toward the first elastic member 121, the first elastic member 121 is pressed away from the first conductive sheet 123, so that the pressing force applied by the first elastic member 121 on the wire or the first conductive sheet 123 is reduced. If the control key 122 slides away from the first elastic member 121, the pressed first elastic member 121 is reset, and the pressing force applied by the first elastic member 121 on the wire or the first conductive sheet 123 increases again.

As a modification example, the control key 122 is directly connected with the first elastic member 121 to control the distance between the first elastic member 121 and the first conductive sheet 123. For example, the control key 122 is arranged at a side of the first elastic member 121 close to the first installation portion 1211, the first elastic member 121 is pulled toward the first installation portion 1211 when the control key 122 slides toward the first installation portion 1211, and the pressing force applied by the first elastic member 121 on the wire or the first conductive sheet 123 is reduced. When the control key 122 slides toward the first conductive sheet 123, the first elastic member 121 is pushed toward the first conductive sheet 123, and the pressing force applied by the first elastic member 121 on the wire or the first conductive sheet 123 increases.

The control key installation portion includes a sliding platform 1111 and a drive hole 1112 adjacent to each other, the sliding platform 1111 is disposed on the inner surface of the bottom wall, and the drive hole 1112 penetrates through the bottom wall. Correspondingly, the control key 122 has an L shape and includes a push portion 1221 and a drive portion 1222 which are perpendicular to each other. The push portion 1221 is installed on the sliding platform 1111, and is configured to be in contact with the first elastic member 121 and move along the extension direction of the sliding platform 1111. The drive portion 1222 penetrates through the drive hole 1112 and reciprocally moves in the radial direction in the driving hole 1112 under the action of an external force. The drive hole 1112 can not only allow the drive portion 1222 to slide therein, but also limit the sliding distance of the control key 122.

Herein, the extension direction of the sliding platform 1111 is perpendicular to the plane where the first conductive sheet 123 is located, so that the distance between the first elastic member 121 and the first conductive sheet 123 can be controlled with the shortest sliding distance.

In a direction from the inner surface of the bottom wall to the outer surface of the bottom wall, the drive portion 1222 has a wedge shape narrowing gradually in the drive hole 1112, that is, the width of the drive portion 1222 gradually decreases in the drive hole 1112, so as to facilitate an external force applying object to extend into the drive hole 1112 from the outer surface of the bottom wall to apply the drive force to the drive portion 1222. In the examples of the present disclosure, the bottom wall is located directly below the electrical cavity, the drive portion 1222 has an inverted quadrangular pyramid shape.

The electrical cavity 111 further includes a terminal connection portion 130 corresponding to the wire connection portion 120, and the terminal connection portion 130 is connected with the conductive terminal of the connector piece. The terminal connection portion 130 includes a second conductive sheet 132, a second elastic member 131, and an arc-shaped hole 1113. The second conductive sheet 132 is electrically connected with the first conductive sheet 123, thereby realizing the electrical connection of the wire connection portion 120 with the terminal connection portion 130, and the second conductive sheet 132 and the first conductive sheet 123 may be integrally formed. The second elastic member 131 may apply pressure to the second conductive sheet 132 to press the second conductive sheet 132 tightly onto the conductive terminal 220 to realize the electrical connection between the conductive terminal 220 and the second conductive sheet 132. The arc-shaped hole 1113 is provided in the bottom wall of the electrical cavity 111 for the conductive terminal 220 to be in a rotatable connection with the second conductive sheet 132 after being inserted into the electrical cavity 111.

The second elastic member 131 may be a coil spring, one end of which is fixedly connected in the electrical cavity 111, and the other end of which is connected to the first surface of the second conductive sheet 132. The second elastic member 131 may apply a force that directs toward the arc-shaped hole 1113 onto the second conductive sheet 132. The conductive terminal 220 abuts against and connects with the second surface of the second conductive sheet 132, and the second surface is opposite to the first surface.

The opening of the central angel of the projection of the arc-shaped hole 1113 in the direction perpendicular to the arc-shaped hole 1113 faces the second conductive sheet 132, and the projection of the second conductive sheet 132 in the direction perpendicular to the arc-shaped hole 1113 has an arch shape, and the arch shape protrudes toward the arc-shaped hole 1113. Therefore, the projection of the central arc segment of the arc-shaped hole 1113 may be partially overlapped with the projection of the second conductive sheet 132. The conductive terminal 220 is inserted into the electrical cavity 111 from one of the two ends of the arc-shaped hole 1113 and rotates toward the central arc segment of the arc-shaped hole 1113. During the rotating of the conductive terminal 220, the second conductive sheet 132 and the second elastic member 131 are pressed, so that the conductive terminal 220 is effectively connected with the second conductive sheet 132.

If the projection of the central arc segment of the arc-shaped hole 1113 in the direction perpendicular to the arc-shaped hole 1113 does not overlap with the projection of the second conductive sheet 132, it may be configured such that the opening size of the two ends of the arc-shaped hole 1113 is larger and the opening size of the central arc segment is smaller, and the conductive terminal 220 of the connector piece may be configured such that the diameter of the end portion of the conductive terminal 220 is larger and the diameter of the root portion of the conductive terminal 220 is smaller. The conductive terminal 220 is inserted into the electrical cavity from one of the two ends of the arc-shaped hole 1113. The conductive terminal 220 is rotated to the arc segment in the middle portion of the arc-shaped hole 1113, the root portion of the conductive terminal 220 is stuck in the arc-shaped hole 1113, and the end portion of the conductive terminal 220 is effectively connected with the second conductive sheet 132.

The first conductive sheet 123 and the second conductive sheet 132 are integrally formed, and the first conductive sheet 123 is subjected to the pressure force from the first elastic member 121 while the second conductive sheet 132 is subjected to the pressure force from the second elastic member 131. In order to prevent the first conductive sheet 123 and the second conductive sheet 132 from being unable to be effectively connected with the wire and the conductive terminal if the first conductive sheet 123 and the second conductive sheet 132 are displaced, the connector seat 100 further includes a conductive sheet installation portion 140 arranged in the electrical cavity 111. The conductive sheet installation portion 140 is integrally formed with the second conductive sheet 123 and has a flat plate shape.

Figure 9:
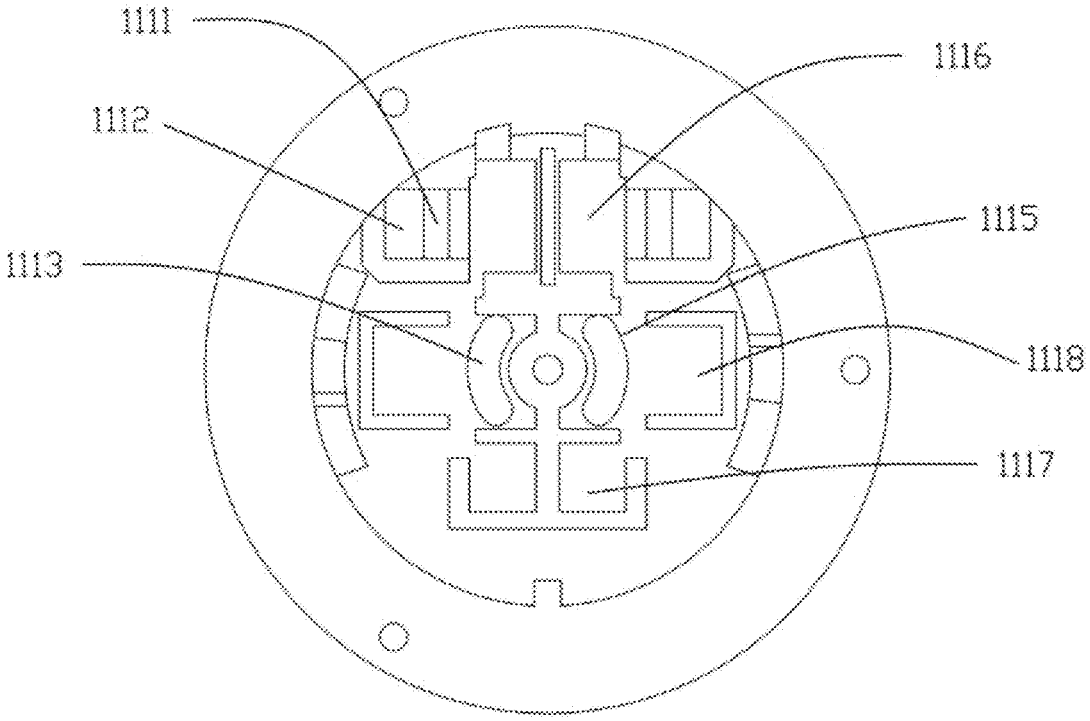
FIG. 9 is a front structural view of a bottom wall of the electrical cavity of the connector seat in FIG. 3.

Referring to FIG. 9, the base body 110 of the connector seat 100 has a cylindrical shape, the electrical cavity 111 has the opening 1114, and the bottom wall opposite to the opening 1114 is arranged with stuck slots for installing the first conductive sheet 123, the second conductive sheet 132, the conductive sheet installation portion 140, the first elastic member 121, and the second elastic member 131. The stuck slots include a first slot 1115, a second slot 1116 and a third slot 1117 arranged opposite to each other at two sides of the first slot 1115, and a fourth slot 1118 located at a perpendicular bisector of a line connecting the first slot 1115, the second slot 1116, and the third slot 1117. The bottom wall of the first slot 1115 is formed with the arc-shaped hole 1113. The whole of the first conductive sheet 123, the second conductive sheet 132, and the conductive sheet installation portion 140 spans the first slot 1115, the second slot 1116, and the third slot 1117. The first conductive sheet is arranged in the second slot 1116, and the second conductive sheet is disposed in the first slot 1115. The first elastic member 121 and the first installation portion 1211 are disposed in the second slot 1116, and the second elastic member 131 is disposed in the fourth slot 1118. The sliding platform 1111 and the drive hole 1112 for installing the control key are arranged at the region between the second slot 1116 and the fourth slot 1118. In the examples of the present disclosure, the electrical cavity 111 has two symmetrically arranged wire connection portions 120, so that the first slot 1115, the second slot 1116, the third slot 1117, the fourth slot 1118, the sliding platform 1111, and the drive hole 1112 are symmetrically arranged at the bottom wall of the electrical cavity 111.

The insulation cover 115 is provided on the opening 1114, and an error prevention structure is provided between the insulation cover 115 and the opening 1114. The insulation cover 115 includes a pressure plate 1151 covering the opening 1114, and a connecting arm 1152 extending from the pressure plate 1151 toward the electrical cavity 111. The center of the pressure plate 1151 has a threaded hole that is threadedly connected with the base body 110 of the connector seat 100. The connecting arm 1152 extends from the opening 1114 into the inner wall of the electrical cavity 111 and extends through the bottom wall of the electrical cavity 111. In order to ensure that the connecting arm 1152 has sufficient elasticity and is effectively stuck with the base body 110 of the connector seat 100, a through hole is arranged at the end of the connecting arm 1152 away from the pressure plate 1151.

The installation ring 114 is arranged on the periphery of the opening 1114 of the connector seat 100, the installation ring 114 is arranged to extend to be away from the opening 1114 in a radial direction, and the installation ring 114 has the hole configured to install the connector seat 100 to a fixture such as the base 420. The fastener passes through the hole of the installation ring 114 to install the installation ring 114 to the base 420. The fastener may be a screw. As a modification example, the installation ring 114 may be connected with the base 420 in a stuck manner.

Figure 10:
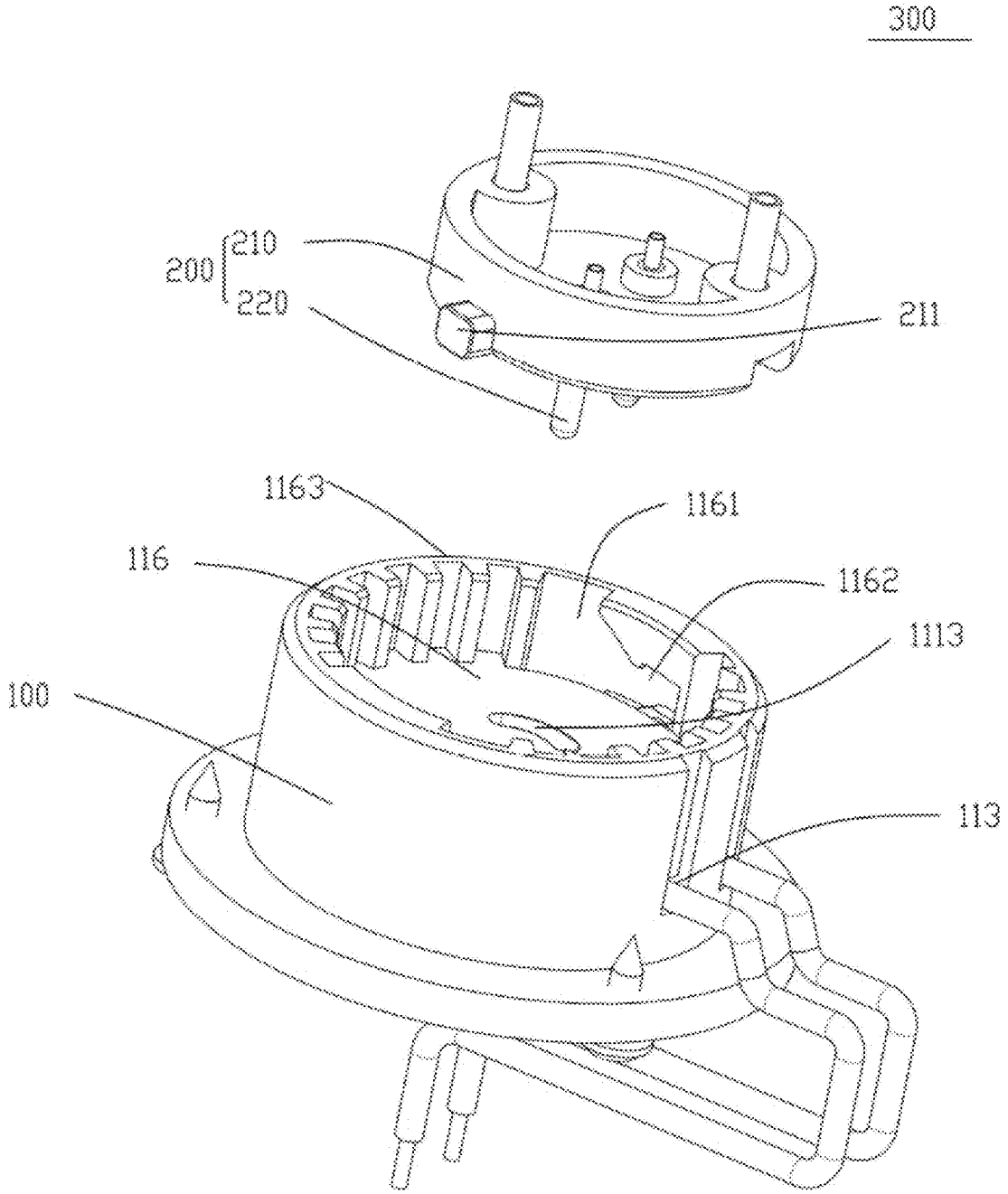
FIG. 10 is an exploded view of a connector component in the example of the present disclosure.

As shown in FIG. 10, the base body 110 of the connector seat 100 includes, in addition to the above-mentioned electrical cavity 111, a mechanical cavity 116 for accommodating the main body 210 of the connector piece 200. An opening 1163 of the mechanical cavity 116 faces away from the opening 1114 of the electrical cavity 111. The electrical cavity 111 and the mechanical cavity 116 communicate with each other through the arc-shaped hole 1113 located at the bottom wall of the electrical cavity 111.

In order that the main body 210 of the connector piece 200 is stuck, the inner wall of the mechanical cavity 116 has at least two guide notches 1161 and at least two stuck notches 1162. The two guide notches 1161 are uniformly arranged on the inner wall of the mechanical cavity 116. The guide notch 1161 extends from the opening of the mechanical cavity 116 toward the electrical cavity, and extends along the axial direction of the inner wall of the mechanical cavity 116 or a direction inclined at a certain angle with respect to the axial direction. The stuck notch 1162 extends from the guide notch 1161 and along the circumferential direction of the inner wall of the mechanical cavity 116 or a direction at a certain angle with respect to the circumferential direction.

In the illumination device 400 of the example of the present disclosure, the connector component 300 includes the connector seat 100 described above, and the connector piece 200 which is capable of being inserted into or separated from the connector seat 100. The connector piece 200 includes the main body 210 configured to be inserted into the mechanical cavity 116 of the connector seat 100 and the conductive terminal 220 located at the main body 210. The main body 210 of the connector piece 200 has the cylindrical shape, and a pair of conductive terminals 220 are provided to pass through the main body 210 in an axial direction of the cylindrical shape. The conductive terminal 220 is a pin whose axis is parallel to the axis of the main body 210 of the cylindrical shape.

During the connector piece 200 is aligned with and connected with the connector seat 100, the connector piece 200 is inserted into the connector seat 100 along a first preset insertion direction, and rotates along a second preset direction to be locked to the connector seat 100, so that the mechanical connection portion of the connector piece 200 is connected with the connector seat 100 in a stuck manner and the electrical connection portion of the connector piece 200 is electrically connected with the connector seat 100. The first preset insertion direction is the extension direction of the guide notch 1161 and the second preset direction is the extension direction of the stuck notch 1162.

During the process of aligning and connecting, the conductive terminal 220 of the connector piece 200 faces the electrical cavity 111, the buckle 211 of the connector piece 200 is aligned with the guide notch 1161 of the connector seat 100, the main body 210 of the connector piece 200 is accommodated in the mechanical cavity 116, the conductive terminal 220 enters into the electrical cavity 111 after passing through the arc-shaped hole 1113, and the connector piece 200 rotates in a clockwise direction, so that the buckle 211 of the connector piece 200 is stuck into the stuck notch 1162 of the connector seat 100, and at the same time, the conductive terminal 220 rotates to the position so that the conductive terminal 220 abuts against the second conductive sheet 132, thereby simultaneously completing the mechanical connection and electrical connection of the connector piece 200 with the connector seat 100.

As a modification example, if the stuck notch 1162 does not extend in the clockwise direction as shown in FIG. 10 but extends in the counterclockwise direction, then after the buckle 211 is inserted into the guide notch 1161, the connector piece 200 is rotated in the counterclockwise direction, so that the buckle 211 is locked into the stuck notch 1162, and the conductive terminal 220 abuts against and is connected with the second conductive sheet 132.

The illumination device 400 according to the examples of the present disclosure further includes the wire 430. The light source module 410 has the connector piece 200 described above. The base 420 is installed at a fixed wall or a fixed installation object and is connected with the connector seat 100. The wire 430 is connected with the wire connection portion 120 of the connector seat 100 to transmit the power from the power supply source to the connector seat 100. The light source module 410 is connected to or separated from the base 420 through the connector component 300 to realize quick replacement and installation. The installation ring 114 of the connector seat 100 is fixedly connected with the base 420 through the fastener.

In the examples of the present disclosure, the connection includes direct connection that the objects directly contact with each other and indirect connection that the objects indirectly contact with each other.

Compared with the other implementations, the light source module 410 provided by the examples of the present disclosure includes the light source component 411 and the connector piece 200, the connector piece 200 is mechanically and electrically connected with the light source component 411. The connector piece has the mechanical connection portion and the electrical connection portion. The mechanical connection portion is mechanically connected with the base 420, and the electrical connection portion is electrically connected with the power supply source through the connector seat 100 provided on the base 420, in other words, by using the connector piece 200, the light source module is quickly installed to the base 420 and is electrically connected with the power supply source at the same time, thereby realizing quick installation or disassembly of the illumination device 400.

With respect to the connector seat 100 provided by the examples of the present disclosure, thread connection is not needed during the wire 430 is installed onto or disassembled from the connector seat 100, that is, the wire 430 is installed onto or removed from the connector seat 100 by rotation operation that does not take much time. The wire 430 is located between the first conductive sheet 123 and the first elastic member 121 upon resisting against the elastic force of the first elastic member 121, and the wire 430 is pressed tightly onto the first conductive sheet 123 by the first elastic member 121 to realize quick electrical connection between the connector seat 100 and the wire 430. If the wire 430 needs to be detached from the connector seat 100, the control key 122 drives the first elastic member 121 to move away from the first conductive sheet 123, the pressing force applied on the wire 430 is reduced, so that the connector seat 100 is quickly separated from the wire 430.

The connector component 300 provided by the examples of the present disclosure can realize quick connection and disconnection of the connector piece 200 and the connector seat 100, and can simultaneously realize mechanical connection and electrical connection of the connector piece 200 and the connector seat 100.

In the illumination device 400 provided by the examples of the present disclosure, the light source module 410 is provided with the connector piece 200 and the base 420 is provided with the connector seat 100, thereby realizing quick connection and disconnection between the light source module 410 and the base 420 and facilitate replacement and maintenance of the light source module 410.

In order to facilitate the installation of the light source module and the disassembly of the light source module in the illumination device, the present disclosure provides the light source module and the illumination device.

The present disclosure provides the light source module, the light source module comprises a light source component and a connector piece, the connector piece is mechanically and electrically connected with the light source component, the connector piece has a mechanical connection portion and an electrical connection portion, the mechanical connection portion is mechanically connected with a base, and the electrical connection portion is electrically connected with a power supply source.

In the above light source module, the light source component surrounds the connector piece, the connector piece is electrically connected with the light source component, and an extension direction of the connector piece and an insertion direction of the connector piece are perpendicular to a surrounding plane surrounded by the light source component.

In the above light source module, the light source component includes a light source substrate and a plurality of light emitting units provided on a surface of the light source substrate, and the connector piece faces away from the plurality of light emitting units.

In the above light source module, the light source substrate surrounds an accommodation region; and the light source module further includes a power supply component, the power supply component is provided in the accommodation region, and the power supply component is electrically connected between the connector piece and the light source component.

In the above light source module, the light source component further includes a light distribution element; and the light distribution element includes an accommodation portion and an optical portion, the accommodation portion is configured to accommodate the power supply component and a part of the connector piece, and the optical portion is configured to accommodate the light source component and distribute a light from the light source component.

In the above light source module, the light distribution element further includes a connection portion connecting the accommodation portion and the optical portion; and at least two connection portions divide the accommodation region into at least two separated spaces.

In the above light source module, the electrical connection portion penetrates through the mechanical connection portion, and is electrically connected with the light source component and the power supply source respectively at two sides of the mechanical connection portion.

In the above light source module, the mechanical connection portion includes a main body, the electrical connection portion includes a conductive terminal, the conductive terminal penetrates through the main body and includes a first portion and a second portion, the first portion and the second portion are respectively provided at two sides of the main body, the first portion is electrically connected with the light source component, and the second portion is electrically connected with the power supply source.

In the above light source module, the main body has a side wall surrounding the conductive terminal, and at least two catching portions are provided on an outer surface of the side wall parallel to the conductive terminal, and the at least two catching portions are connected with the base in a stuck manner.

In order to solve the above problems, the present disclosure provides the illumination device, which includes the base and the light source module as described above, the base has a connector seat, the connector seat is electrically connected with the power supply source, and the connector seat and the connector piece are connected with each other to realize a mechanical installation of the light source module and a connection between the light source module and the power supply source.

In the above illumination device, the connector piece is inserted into the connector seat along a first preset direction and rotates along a second preset direction to be locked to the connector seat, so that the mechanical connection portion of the connector piece is connected with the connector seat in a stuck manner, and the electrical connection portion of the connector piece is electrically connected with the connector seat.

In the above illumination device, the base has reinforcing ribs, and the reinforcing ribs radiate outwardly from a center of the base.

In the above illumination device, the connector seat comprises a base body, a wire connection portion and a terminal connection portion; the base body has an electrical cavity; the wire connection portion and the terminal connection portion are provided in the electrical cavity; and the wire connection portion is connected with a wire, and the terminal connection portion is connected with the conductive terminal of the connector piece.

In the above illumination device, the connector seat further comprises a mechanical cavity, the mechanical cavity has an opening; and the electrical cavity has an opening and a bottom wall which is opposite to the opening, the opening of the electrical cavity and the opening of the mechanical cavity face away from each other, and an arc-shaped hole communicating with the mechanical cavity is provided on the bottom wall, so that the conductive terminal of the connector piece extends into the electrical cavity from the mechanical cavity and is connected with the terminal connection portion.

In the above illumination device, the base body is fixedly connected with the base; and the base has a wire passing hole through which the wire passes, and the wire is electrically connected with the wire connection portion.

Compared with the other implementations, the light source module provided by the present disclosure includes the light source component and the connector piece which are mechanically connected and electrically connected with each other. The connector piece has the mechanical connection portion and the electrical connection portion, the mechanical connection portion is mechanically connected with the base, and the electrical connection portion is electrically connected with the power supply source, the base and the power supply source are connected with the connector piece at the same time, so that the operation of respectively connecting two components, when installing and disassembling the light source module, is avoided, thereby improving the efficiencies of installation of the light source module and the disassembly of the light source module.

The present disclosure provides a method of manufacturing a light source module. The method may include providing a light source component and a connector piece; mechanically and electrically connecting the connector piece with the light source component, where the connector piece may have a mechanical connection portion and an electrical connection portion; mechanically connecting the mechanical connection portion with a base; and electrically connecting the electrical connection portion with a power supply source.

The method may also include surrounding the connector piece by using the light source component; electrically connecting the connector piece with the light source component; and providing an extension direction of the connector piece and an insertion direction of the connector piece that are perpendicular to a surrounding plane surrounded by the light source component.

In the method, the light source component may include a light source substrate and a plurality of light emitting units provided on a surface of the light source substrate, and the connector piece may face away from the plurality of light emitting units.

In the method, the light source substrate may surround an accommodation region; and the light source module may include a power supply component, where the power supply component may be provided in the accommodation region, and the power supply component may be electrically connected between the connector piece and the light source component.

In the method, the light source component may include a light distribution element; the light distribution element may include an accommodation portion and an optical portion; and the accommodation portion may be configured to accommodate the power supply component and a part of the connector piece, and the optical portion may be configured to accommodate the light source component and distribute a light from the light source component.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The examples described above further explain the objects, technical solutions and beneficial effects of the present disclosure. It should be understood that the above examples are only the examples of the present disclosure and are not used to limit the present disclosure. Any modifications, equivalent replacements, improvements, etc., made within the spirit and principle of the present disclosure shall include within the protection scope of the present disclosure.

What is claimed is:

1. A light source module, comprising:

a light source component; and a connector piece, wherein the connector piece is mechanically and electrically connected with the light source component, the connector piece has a mechanical connection portion and an electrical connection portion, wherein the mechanical connection portion is mechanically connected with a base, the electrical connection portion is electrically connected with a power supply source, and the connector piece is inserted into a connector seat of the base along a first preset direction and rotates along a second preset direction to be locked to the connector seat.

2. The light source module according to claim 1, wherein:

the light source component surrounds the connector piece, the connector piece is electrically connected with the light source component, and an extension direction of the connector piece and an insertion direction of the connector piece are perpendicular to a surrounding plane surrounded by the light source component.

3. The light source module according to claim 1, wherein:

the light source component comprises a light source substrate and a plurality of light emitting units provided on a surface of the light source substrate, and the connector piece faces away from the plurality of light emitting units.

4. The light source module according to claim 3, wherein:

the light source substrate surrounds an accommodation region; and the light source module further comprises a power supply component, wherein the power supply component is provided in the accommodation region, and the power supply component is electrically connected between the connector piece and the light source component.

5. The light source module according to claim 4, wherein:

the light source component further comprises a light distribution element;

the light distribution element comprises an accommodation portion and an optical portion; and the accommodation portion is configured to accommodate the power supply component and a part of the connector piece, and the optical portion is configured to accommodate the light source component and distribute a light from the light source component.

6. The light source module according to claim 5, wherein:

the light distribution element further comprises a connection portion connecting the accommodation portion and the optical portion; and at least two connection portions divide the accommodation region into at least two separated spaces.

7. The light source module according to claim 1, wherein:

the electrical connection portion penetrates through the mechanical connection portion, and the electrical connection portion is electrically connected with the light source component and the power supply source at two sides of the mechanical connection portion.

8. The light source module according to claim 7, wherein:

the mechanical connection portion comprises a main body, the electrical connection portion comprises a conductive terminal, the conductive terminal penetrates through the main body and the conductive terminal comprises a first portion and a second portion, and the first portion and the second portion are provided at two sides of the main body, wherein the first portion is electrically connected with the light source component, and the second portion is electrically connected with the power supply source.

9. The light source module according to claim 8, wherein:

the main body has a side wall surrounding the conductive terminal, and at least two catching portions are provided on an outer surface of the side wall parallel to the conductive terminal, and wherein the at least two catching portions are connected with the base in a stuck manner.

10. An illumination device, comprising:

a base; and a light source module, wherein the light source module comprises a light source component and a connector piece, and wherein the connector piece is mechanically and electrically connected with the light source component, the connector piece has a mechanical connection portion and an electrical connection portion, wherein the mechanical connection portion is mechanically connected with a base, and the electrical connection portion is electrically connected with a power supply source;

wherein the base has a connector seat, the connector seat is electrically connected with the power supply source, the connector seat and the connector piece are connected with each other to realize a mechanical installation of the light source module and a connection between the light source module and the power supply source, and the connector piece is inserted into the connector seat along a first preset direction and rotates along a second preset direction to be locked to the connector seat.

11. The illumination device according to claim 10, wherein:

the mechanical connection portion of the connector piece is connected with the connector seat in a stuck manner, and the electrical connection portion of the connector piece is electrically connected with the connector seat.

12. The illumination device according to claim 10, wherein:

the base has reinforcing ribs, and the reinforcing ribs radiate outwardly from a center of the base.

13. The illumination device according to claim 10, wherein:

the connector seat comprises a base body, a wire connection portion and a terminal connection portion;

the base body has an electrical cavity;

the wire connection portion and the terminal connection portion are provided in the electrical cavity; and the wire connection portion is connected with a wire, and the terminal connection portion is connected with the conductive terminal of the connector piece.

14. The illumination device according to claim 13, wherein:

the connector seat further comprises a mechanical cavity, the mechanical cavity has an opening; and the electrical cavity has an opening and a bottom wall which is opposite to the opening, the opening of the electrical cavity and the opening of the mechanical cavity face away from each other, and an arc-shaped hole communicating with the mechanical cavity is provided on the bottom wall, so that the conductive terminal of the connector piece extends into the electrical cavity from the mechanical cavity and is connected with the terminal connection portion.

15. The illumination device according to claim 13, wherein:

the base body is fixedly connected with the base; and the base has a wire passing hole through which the wire passes, and the wire is electrically connected with the wire connection portion.

16. A method of manufacturing a light source module, comprising:

providing a light source component and a connector piece;

mechanically and electrically connecting the connector piece with the light source component, wherein the connector piece has a mechanical connection portion and an electrical connection portion;

mechanically connecting the mechanical connection portion with a base by inserting the connector piece into a connector seat of the base along a first preset direction and rotating along a second preset direction to be locked to the connector seat; and electrically connecting the electrical connection portion with a power supply source.

17. The method according to claim 16, further comprising:

surrounding the connector piece by using the light source component;

electrically connecting the connector piece with the light source component; and providing an extension direction of the connector piece and an insertion direction of the connector piece that are perpendicular to a surrounding plane surrounded by the light source component.

18. The method according to claim 16, wherein:

the light source component comprises a light source substrate and a plurality of light emitting units provided on a surface of the light source substrate, and the connector piece faces away from the plurality of light emitting units.

19. The method according to claim 18, wherein:

the light source substrate surrounds an accommodation region; and the light source module further comprises a power supply component, wherein the power supply component is provided in the accommodation region, and the power supply component is electrically connected between the connector piece and the light source component.

20. The method according to claim 19, wherein:

the light source component further comprises a light distribution element;

the light distribution element comprises an accommodation portion and an optical portion; and the accommodation portion is configured to accommodate the power supply component and a part of the connector piece, and the optical portion is configured to accommodate the light source component and distribute a light from the light source component.

* * * * *